US012558595B2

(12) United States Patent
Shinohara

(10) Patent No.: US 12,558,595 B2
(45) Date of Patent: Feb. 24, 2026

(54) GOLF BALL

(71) Applicant: Bridgestone Sports Co., Ltd., Tokyo (JP)

(72) Inventor: Hirotaka Shinohara, Saitamaken (JP)

(73) Assignee: BRIDGESTONE SPORTS CO., LTD., Tokyo (JP)

( * ) Notice: Subject to any disclaimer, the term of this patent is extended or adjusted under 35 U.S.C. 154(b) by 110 days.

(21) Appl. No.: 18/536,775

(22) Filed: Dec. 12, 2023

(65) Prior Publication Data

US 2024/0207690 A1 Jun. 27, 2024

(30) Foreign Application Priority Data

Dec. 23, 2022 (JP) ..... 2022-206365

(51) Int. Cl.
*A63B 37/06* (2006.01)
*A63B 37/00* (2006.01)

(52) U.S. Cl.
CPC .. *A63B 37/00691* (2020.08); *A63B 37/00495* (2020.08); *A63B 37/0075* (2013.01)

(58) Field of Classification Search
CPC ..... A63B 37/00691; A63B 37/00495; A63B 37/0075
See application file for complete search history.

(56) References Cited

U.S. PATENT DOCUMENTS

| | | | | |
|---|---|---|---|---|
| 6,390,937 | B1 | 5/2002 | Marshall et al. | |
| 2004/0042586 | A1 | 3/2004 | Furze | |
| 2004/0196956 | A1 | 10/2004 | Furze | |
| 2010/0255938 | A1* | 10/2010 | Komatsu | A63B 37/0021 473/378 |
| 2011/0224020 | A1* | 9/2011 | Tachibana | A63B 43/008 473/378 |
| 2020/0406105 | A1* | 12/2020 | Suzuki | A63B 37/0039 |

FOREIGN PATENT DOCUMENTS

| | | | |
|---|---|---|---|
| JP | 2001-259083 | A | 9/2001 |
| JP | 2016-065749 | A | 4/2016 |
| JP | 2019-132863 | A | 8/2019 |
| JP | 2021-063821 | A | 4/2021 |

* cited by examiner

*Primary Examiner* — Raeann Gorden
(74) *Attorney, Agent, or Firm* — Sughrue Mion, PLLC

(57) ABSTRACT

The present invention provides a golf ball in which at least one intermediate layer is formed between a core and a cover, wherein an L value (brightness) of the core is not more than 85 in a Lab display based on JIS Z 8722, an L value (brightness) of a sphere (intermediate layer-encased sphere) obtained by encasing the core with the intermediate layer is at least 75 in the Lab display based on JIS Z 8722, a total light transmittance of the intermediate layer at a thickness of 1.0 mm is 1 to 50%, and a color difference ΔE between the core and the intermediate layer-encased sphere is at least 10.

6 Claims, 2 Drawing Sheets

GOLF BALL

CROSS-REFERENCE TO RELATED APPLICATIONS

This non-provisional application claims priority under 35 U.S.C. § 119(a) on Patent Application No. 2022-206365 filed in Japan on Dec. 23, 2022, the entire contents of which are hereby incorporated by reference.

TECHNICAL FIELD

The present invention relates to a golf ball in which at least one intermediate layer is formed between a core and a cover. More specifically, the present invention relates to a golf ball that includes a core having a low brightness and an intermediate layer having a certain transparency, thereby making it possible to easily determine an eccentricity of the core.

BACKGROUND ART

In recent golf balls, multilayering and thinning a gauge of a cover (outermost layer) encasing a core and of an encasing layer of an intermediate layer have been advanced using injection molding or compression molding from the viewpoints of the feel at impact of the ball and of low spin. As the techniques of multilayering the encasing layer and of thin gauge manufacturing progress, there is a problem in that the gauge of the encasing layer is uneven, that is, eccentricity occurs. The position of the center of gravity of an uneven golf ball changes, which greatly affects the straightness of the ball.

As a method of inspecting eccentricity without destroying the ball, generally, a method of observing a thickness with ultrasound or an inspection of visualizing the inside of the ball with X-rays are performed. For example, Patent Document 1 proposes a technique for confirming the eccentricity of a ball by using a polymer material doped with barium or bismuth and irradiating the ball with X-rays by an X-ray imaging device. Similarly, Patent Documents 2 and 3 describe a method for inspecting the eccentricity of a golf ball with X-rays. In addition, Patent Documents 4 to 6 propose a method for irradiating a two-piece golf ball with a terahertz wave instead of X-rays to calculate the eccentricity amount of the core in the golf ball.

However, in the eccentricity inspection described in these patent documents, the equipment investment costs for X-ray imaging devices and the like increase, and providing such an inspection process results in poor productivity in the manufacturing process of the golf ball. Therefore, it is desirable to improve the internal configuration of the ball so that an operator who manufactures the golf ball can easily confirm the eccentricity simply by visually observing an intermediate product such as the ball or an intermediate layer-encased sphere.

CITATION LIST

Patent Document 1: JP-A 2001-259083
Patent Document 2: US 2004/0042586
Patent Document 3: US 2004/0196956
Patent Document 4: JP-A 2016-65749
Patent Document 5: JP-A 2019-132863
Patent Document 6: JP-A 2021-63821

SUMMARY OF THE INVENTION

The present invention has been made in view of the above circumstances, and an object of the present invention is to provide a golf ball in which it is not necessary to provide an inspection device such as an X-ray imaging device, and in which an eccentricity of a core can be easily confirmed by visual observation by an operator in a production process of the golf ball.

As a result of intensive studies to achieve the above object, the present inventor has found that in a golf ball in which an intermediate layer is formed between a core and a cover, by adjusting a relationship between a material and a color tone of both members of the core and the intermediate layer adjacent to the core, specifically, by setting a color of the core to a low L value (brightness) of not more than 85 in a Lab display, finishing the intermediate layer to be translucent so that a total light transmittance is 1 to 50%, setting a color of a sphere (intermediate layer-encased sphere) in which the core is encased with the intermediate layer to a high L value (brightness) of at least 75 in the Lab display, and setting a color difference ΔE between the core and the intermediate layer-encased sphere to be larger than a certain value, the eccentricity of the core can be easily determined by an operator at a glance, and a golf ball having no eccentricity may be reliably manufactured without using an inspection device such as an expensive X-ray imaging device, and has completed the present invention.

Accordingly, the present invention provides a golf ball including at least one intermediate layer formed between a core and a cover, wherein an L value (brightness) of the core is not more than 85 in a Lab display based on JIS Z 8722, an L value (brightness) of a sphere (intermediate layer-encased sphere) obtained by encasing the core with the intermediate layer is at least 75 in the Lab display based on JIS Z 8722, a total light transmittance of the intermediate layer at a thickness of 1.0 mm is 1 to 50%, and a color difference ΔE between the core and the intermediate layer-encased sphere is at least 10.

In a preferred embodiment of the golf ball according to the invention, the intermediate layer has a thickness of 0.8 to 1.5 mm.

In another preferred embodiment of the inventive golf ball, the L value (brightness) of the core is not more than 80.

In yet another preferred embodiment, the color difference ΔE between the core and the intermediate layer-encased sphere is at least 20.

In still another preferred embodiment, the intermediate layer has a total light transmittance of at least 25% at a thickness of 1.0 mm.

In a further preferred embodiment, the intermediate layer contains barium sulfate.

In a yet further preferred embodiment, a content of the barium sulfate is 8 to 20 wt % of a total amount of materials of the intermediate layer.

Advantageous Effects of the Invention

With the golf ball of the present invention, in a manufacturing process of the golf ball, the eccentricity of the core can be easily determined by visual observation by an operator, and the golf ball having no eccentricity may be reliably obtained with good workability without using an inspection device.

DETAILED DESCRIPTION OF THE INVENTION

Hereinafter, the present invention is described in more detail.

Figure 2:
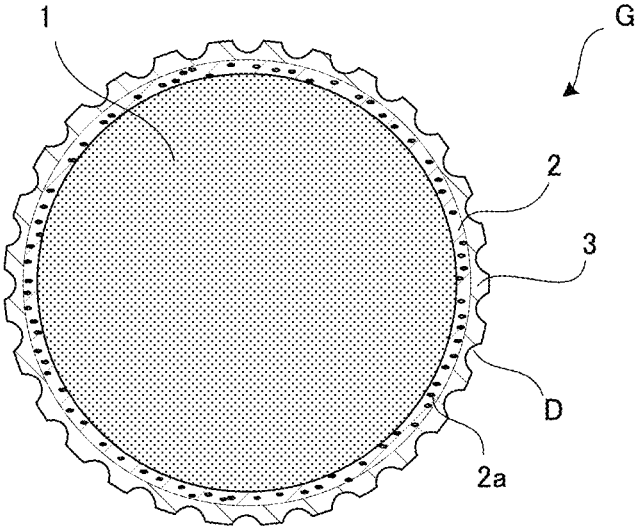
FIG. 2 is a schematic cross-sectional view of the golf ball according to the invention.

A golf ball of the present invention includes a core, a cover, and an intermediate layer formed therebetween. Referring to FIG. 2, the golf ball of the invention is a golf ball G including core 1, intermediate layer 2, and cover 3. Intermediate layer 2 is formed between core 1 and cover 3. Numerous dimples D are typically formed on the surface of cover 3. Intermediate layer 2 may be finished to be translucent by blending substances 2*a* in the resin composition.

Illustrative examples of substances 2*a* include titanium oxide, various pigments, barium sulfate, and calcium carbonate. Among these substances, barium sulfate is preferably used from the viewpoints of durability and transparency of the intermediate layer-encased sphere. Hereinafter, each of the above layers is described in detail.

The core may be formed in a single layer or a plurality of layers. As a material of the core, a known rubber material or various resin materials may be used as a substrate. When the core is formed of a rubber material, a known base rubber such as a natural rubber or a synthetic rubber may be used as the base rubber, and more specifically, it is recommended to mainly use polybutadiene, particularly cis-1,4-polybutadiene having at least 40% or more of a cis structure. In addition, in the base rubber, a natural rubber, a polyisoprene rubber, a styrene butadiene rubber, and the like may be used in combination with the above-described polybutadiene as desired. In addition, polybutadiene may be synthesized by a Ziegler-type catalyst such as a titanium-based catalyst, a cobalt-based catalyst, a nickel-based catalyst, or a neodymium-based catalyst, or by a metal catalyst such as cobalt or nickel.

In the base rubber, a co-crosslinking agent such as an unsaturated carboxylic acid and a metal salt thereof, an inorganic filler such as zinc oxide, barium sulfate, or calcium carbonate, an organic peroxide such as dicumyl peroxide or 1,1-bis(t-butylperoxy)cyclohexane, or the like may be blended. If necessary, a commercially available antioxidant or the like may be appropriately added.

In addition, as described later, various pigments may be blended in the base rubber so that the color of the core has a certain low brightness. As the pigment, an inorganic pigment such as graphite or titanium oxide, or an organic pigment such as quinacrine red, phthalocyanine blue, or isoindoline yellow may be used.

The compounding amount of the pigment is preferably at least 0.05 parts by weight, more preferably at least 0.1 parts by weight, and still more preferably at least 0.2 parts by weight per 100 parts by weight of the base rubber. In addition, if the compounding amount of the pigment is more than 1.0 parts by weight, the effect of making the color of the core have a certain low brightness is not much exhibited.

The core may be manufactured by thermally curing a rubber composition containing the above components. For example, a molded body may be manufactured by intensively mixing the rubber composition using a mixing apparatus such as a Banbury mixer or a roll mill, subsequently compression molding or injection molding the mixture using a core mold, and curing the resulting molded body by appropriately heating it at a temperature sufficient for the organic peroxide and the co-crosslinking agent to act, such as at a temperature of 100 to 200° C., and preferably at a temperature of 140 to 180° C., for 10 to 40 minutes.

When a pigment is not blended in the rubber composition, the rubber composition may be thermally cured to obtain a core, and then the surface of the core may be coated with a pigment.

An L value (brightness) of the core is not more than 85, preferably not more than 80, and more preferably not more than 70. If this value is too low, the core appears dark, and it becomes difficult to identify the presence or absence of eccentricity of the core. When the core is formed in a plurality of layers, the L value of the core is the L value of the outer layer core.

The above-described L value means an L value of a Lab display based on the standard of JIS Z 8722. The L value (brightness) indicates a degree of brightness of a color and does not have information about a hue. When the L value (brightness) is high, it means a bright color, and when the L value is low, it means a dark color or a dull color. As a method for measuring these numerical values, a known color difference meter may be used, and examples thereof include a model MSC-IS-2DH (manufactured by Suga Test Instruments Co., Ltd.). Hereinafter, in the present specification, all L values have the above meanings.

At least one intermediate layer and one cover may be formed around the core as a member encasing the core. When the intermediate layer includes two layers, the layers may be referred to in order from the inner side as a surrounding layer, an intermediate layer, and an outermost layer. Furthermore, the intermediate layer may include at least three layers, and in this case, the layers may be referred to in order from the inner side as an inner surrounding layer, an outer surrounding layer, an intermediate layer, and an outermost layer.

The intermediate layer is formed of a resin composition. Examples of the resin composition include a resin composition mainly composed of a resin conventionally employed as a material for golf balls. Examples of the resin include an ionomer-based resin, a polyester resin, a polyurethane resin, a polyamide resin, a polyolefin resin, an olefin-based thermoplastic elastomer, and a styrene-based thermoplastic elastomer. In particular, an ionomer-based resin is preferable from the viewpoints of rebound and moldability.

In the resin composition, it is preferable to blend substances such as titanium oxide, various pigments, barium sulfate, and calcium carbonate. By blending these substances in the resin composition, the intermediate layer may be finished to be translucent. Among these substances, barium sulfate is preferably used from the viewpoints of durability and transparency of the intermediate layer-encased sphere.

When barium sulfate is used, the compounding amount of the barium sulfate is preferably in the range of 8 to 20 wt % per 100 wt % of the total amount of the resin composition. If the compounding amount is larger than the above range, a color of the intermediate layer becomes cloudy, and translucency may become difficult to maintain. On the other hand, if the compounding amount is smaller than the above range, a transparency of the intermediate layer increases, and it becomes difficult to detect eccentricity due to color difference. In general, in an eccentric state of the core, durability in a thin portion of the intermediate layer encasing the core is deteriorated. Therefore, not only is barium sulfate added to adjust a transmittance of the intermediate layer member, but also the deterioration in durability may be prevented by blending barium sulfate in the intermediate layer even if the above-described eccentricity occurs. In addition, for the purpose of coloring the resin, an inorganic pigment such as graphite or titanium oxide, or an organic pigment such as quinacrine red, phthalocyanine blue, or isoindoline yellow may be used as the pigment.

A thickness of the intermediate layer is preferably at least 0.8 mm, more preferably at least 1.0 mm, and still more preferably at least 1.2 mm, and the upper limit thereof is preferably not more than 2.0 mm, more preferably not more than 1.5 mm, and still more preferably not more than 1.3 mm. If the intermediate layer is too thick, the transmittance of the intermediate layer decreases, and the color of the core itself inside the intermediate layer-encased sphere may become difficult to see. On the other hand, if the intermediate layer is too thin, the transparency becomes high, and in either case, eccentricity becomes difficult to detect due to color difference.

The L value (brightness) of the sphere (intermediate layer-encased sphere) in which the core is encased with the intermediate layer is at least 75, preferably at least 80, and more preferably at least 85. If this value is lower than the above range, it is difficult to clearly distinguish a boundary between the intermediate layer and the core, and the accuracy of an eccentricity inspection may be deteriorated.

In addition, since the intermediate layer is translucent, the total light transmittance of the intermediate layer at a thickness of 1.0 mm is required to be 1 to 50%. If this value exceeds 50%, that is, the transparency of the intermediate layer itself increases, and the intermediate layer as a whole appears to be the same color, eccentricity becomes difficult to detect. The total light transmittance is a value obtained by measuring the total light transmittance in accordance with JIS K 7361. For example, the total light transmittance may be measured using a product with the name "NDH 5000" manufactured by Nippon Denshoku Industries Co., Ltd. The lower limit of the total light transmittance of the intermediate layer is preferably at least 25%, and more preferably at least 30%.

Furthermore, the color difference ΔE between the core and the sphere (intermediate layer-encased sphere) in which the core is encased with the intermediate layer is required to be at least 10, preferably at least 15, and more preferably at least 20, and the larger this value is, the easier it becomes for eccentricity to be detected. The color difference may be calculated by $$\Delta E = [(\Delta L)^2 + (\Delta a)^2 + (\Delta b)^2]^{1/2}$$

based on the standard of JIS Z 8722.

As described above, L represents brightness. In addition, a and b represent colors, a represents a red-green direction, and b represents a yellow-blue direction. Therefore, as the value a increases, the redness tends to increase, as the value a decreases, the greenness tends to increase, as the value b increases, the yellowness tends to increase, and as the value b decreases, the blueness tends to increase.

The cover is formed of a resin composition. Although not particularly limited, specifically, the resin composition may be formed using an ionomer resin, a polyurethane-based thermoplastic elastomer, a thermosetting polyurethane, or a mixture thereof as a principal component of the resin composition. In addition to the above principal component, other thermoplastic elastomers, polyisocyanate compounds, fatty acids or derivatives thereof, basic inorganic metal compounds, fillers, and the like may be added to the cover.

The resin composition may be obtained, for example, by mixing the above-described components using various kneaders such as a knead-type twin-screw (or single-screw) extruder, a Banbury mixer, or a kneader.

One kind or two or more kinds of a large number of dimples may be typically formed on the surface of the cover, and the shape, diameter, depth, number, occupied surface area, and the like of the dimples are appropriately selected.

The method for producing the golf ball is not particularly limited, and the golf ball may be obtained by molding by a known molding method such as injection molding or compression molding. For example, the resin composition for the intermediate layer described above is supplied in a state where the core is set in a mold of an injection molding machine to produce a layer-encased sphere (intermediate layer-encased sphere) in which the core is encased with the intermediate layer, then the intermediate layer-encased sphere is set in a mold of another injection molding machine, and the resin composition for the cover is injected to produce a golf ball encased with the cover.

In addition, a coating layer may be formed on the surface of the cover. In this case, the coating layer is formed of a coating composition. The base resin of the coating composition is not particularly limited, and examples thereof include a polyurethane resin, an epoxy resin, a polyester resin, an acrylic resin, and a cellulose resin. From the viewpoint of durability of the coating layer, it is preferable to use a two-liquid curable polyurethane resin. In the coating composition, various additives such as an antioxidant, an ultraviolet absorber, a light stabilizer, a fluorescent agent, and a fluorescent brightener may be blended in an appropriate amount as necessary.

The method for applying the coating material to the surface of the cover is not particularly limited, and a known method may be used, and electrostatic coating, spray gun coating, brush coating, or the like may be adopted.

A ball standard such as a weight and a diameter of the golf ball of the present invention may be appropriately set according to the Rules of Golf.

EXAMPLES

Hereinafter, the present invention is specifically described with reference to Examples and Comparative Examples, but the present invention is not limited to the following Examples.

Examples 1 to 3 and Comparative Examples 1 to 6

As a core common to each example of the Examples and Comparative Examples, a core composition was adjusted by blending the rubbers shown in the following Table 1, and then vulcanization was performed at 153° C. for 19 minutes to produce nine kinds of cores having a diameter of 38.7 mm.

TABLE 1

| Core formulation (pbw) | | No. 1 Red | No. 2 Light red | No. 3 Blue | No. 4 Light blue | No. 5 Yellow | No. 6 Orange | No. 7 Light green | No. 8 Light purple | No. 9 White |
|---|---|---|---|---|---|---|---|---|---|---|
| Polybutadiene | | 100 | 100 | 100 | 100 | 100 | 100 | 100 | 100 | 100 |
| Organic peroxide | | 1.0 | 1.0 | 1.0 | 1.0 | 1.0 | 1.0 | 1.0 | 1.0 | 1.0 |
| Zinc oxide | | 18.1 | 18.1 | 18.1 | 18.1 | 18.1 | 18.1 | 18.1 | 18.1 | 18.1 |
| Zinc acrylate | | 37 | 37 | 37 | 37 | 37 | 37 | 37 | 37 | 37 |
| Water | | 0.3 | 0.3 | 0.3 | 0.3 | 0.3 | 0.3 | 0.3 | 0.3 | 0.3 |
| Pentachlorothiophenol zinc salt | | 0.2 | 0.2 | 0.2 | 0.2 | 0.2 | 0.2 | 0.2 | 0.2 | 0.2 |
| Pigment product | Resino Yellow GL-6-B | | | | | q.s. | q.s. | q.s. | | |
| | Resino Red K | q.s. | q.s. | | | | q.s. | | q.s. | |
| | Resino Blue KP-25 | | | q.s. | q.s. | | | q.s. | q.s. | |

Details of the above formulations are as follows.

Polybutadiene: Trade name "BRO1" (manufactured by JSR Corporation)

Organic peroxide: Dicumyl peroxide, trade name "Percumyl D" (manufactured by NOF Corporation)

Zinc oxide: Trade name "Grade 3 Zinc Oxide" (manufactured by Sakai Chemical Industry Co., Ltd.)

Zinc acrylate: Trade name "ZN-DA85S" (manufactured by Nippon Shokubai Co., Ltd.)

Water: Pure water (manufactured by Seiki Co., Ltd.)

Zinc salt of pentachlorothiophenol: Manufactured by Wako Pure Chemical Industries, Ltd.

Product name "Resino Yellow GL-6-B3" (yellow) manufactured by Resino Color Industry Co., Ltd. (pigment used is Disazo Yellow)

Product name "Resino Red K" (red) manufactured by Resino Color Industry Co., Ltd. (pigment used is Lake Red)

Product name "Resino Blue KP-25" (blue) manufactured by Resino Color Industry Co., Ltd. (pigment used is phthalocyanine blue)

Formation of Intermediate Layer-Encased Sphere

Figure 1:
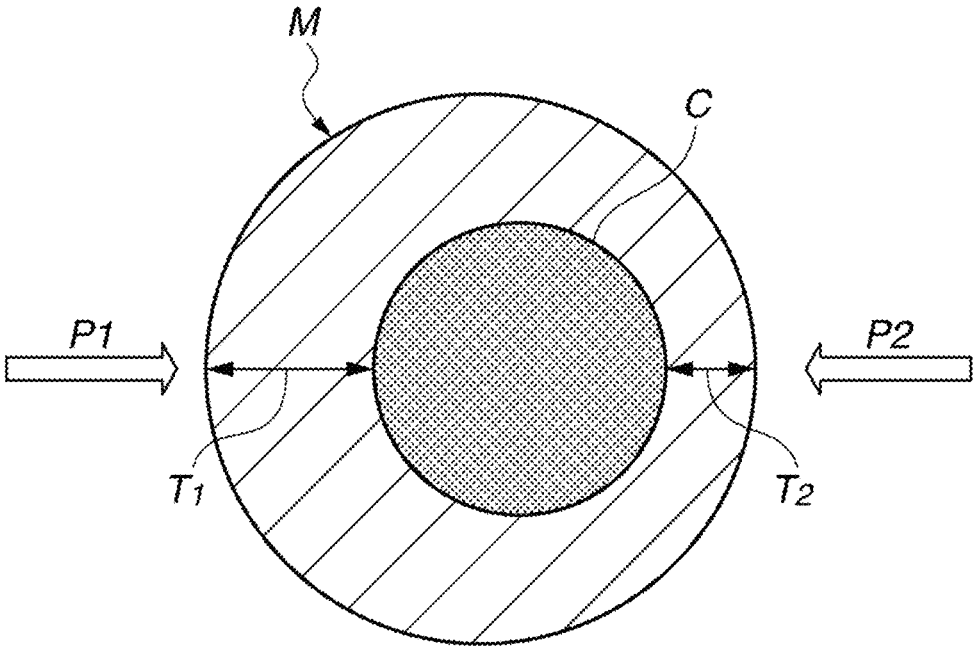
FIG. 1 is a schematic view for explaining a state of eccentricity of a core in an intermediate layer-encased sphere.

Next, using an injection mold for forming an intermediate layer, injection molding is performed around the core surface with the resin materials A to F of the intermediate layer shown in Table 2. In this injection mold, when a core having a diameter of 38.7 mm is disposed at the center of a cavity, the diameter of the cavity is 41.1 mm so that an intermediate layer having a thickness of 1.2 mm is formed. However, in the present Example, as illustrated in FIG. 1, by shifting the core from the center of the cavity, an intermediate layer-encased sphere M was produced in which an eccentric core C was disposed so that the cavity forming the intermediate layer had a thickness of 1.7 mm on one side $T_1$ and a thickness of 0.7 mm on the other side $T_2$.

Details of the materials in Table 2 are as follows.

"AM7318" ionomer resin manufactured by Dow-Mitsui Polychemicals Co., Ltd.

"Himilan 1706" ionomer resin manufactured by Dow-Mitsui Polychemicals Co., Ltd.

Total Light Transmittance of Intermediate Layer Material

The intermediate layer material was molded to prepare resin sheets having thicknesses described in Table 2, and the total light transmittance was measured with a haze meter having the product name "NDH 5000" manufactured by Nippon Denshoku Industries Co., Ltd.

The color tone, color difference, and color difference at the time of eccentricity were measured by the following methods in each example for the obtained cores and spheres (intermediate layer-encased spheres) in which the core was encased with the intermediate layer.

Color Tone

The color tone of each sphere (core and intermediate layer-encased sphere) was measured using a color difference meter (model: MSC-IS, manufactured by Suga Test Instruments Co., Ltd.), and the brightness (L value) and a saturation (C value) were determined based on the Lab color of JIS Z 8722.

The color difference is calculated as follows based on the standard of JIS Z 8722.

$$\Delta E = [(\Delta L)^2 + (\Delta a)^2 + (\Delta b)^2]^{1/2}$$

Color Difference at the Time of Eccentricity

As shown in FIG. 1, the color difference of the intermediate layer-encased sphere M in the eccentric state of the core C is determined. In this measurement method, the color tone of the intermediate layer-encased sphere in the direction of an arrow P1 in FIG. 1 (the side on which the thick intermediate layer $T_1$ is located) and the color tone of the

TABLE 2

| | | A | B | C | D | E | F |
|---|---|---|---|---|---|---|---|
| Intermediate layer material (composition: pbw) | Himilan AM7318 | 85 | 85 | 85 | 85 | 85 | 85 |
| | Himilan 1706 | 15 | 15 | 15 | 15 | 15 | 15 |
| | Trimethylolpropane | 1.1 | 1.1 | 1.1 | 1.1 | 1.1 | 1.1 |
| | Barium sulfate | 0 | 5 | 10 | 15 | 20 | 0 |
| | Titanium oxide | 0 | 0 | 0 | 0 | 0 | 1.5 |
| Total light transmittance (%) | Thickness 1.0 mm | 91.3 | 59.8 | 48.5 | 36 | 30.1 | 0.1 |
| | Thickness 1.5 mm | 90.3 | 54.8 | 45.1 | 34.6 | 25.4 | 0.09 |
| | Thickness 3.0 mm | 85.1 | 32 | 27.1 | 19.6 | 13.2 | 0 |
| | Thickness 4.5 mm | 81.8 | 21.7 | 18.8 | 12 | 7.6 | 0 |
| Specific gravity | | 0.952 | 0.991 | 1.024 | 1.059 | 1.093 | 0.97 |

intermediate layer-encased sphere in the direction of the arrow P2 in FIG. 1 (the side on which the thin intermediate layer $T_2$ is located) were measured, and the difference in brightness ΔL and the color difference ΔE when the two portions were measured are described as "Color difference at the time of eccentricity" in Tables 3 to 8.

The eccentricity inspection was performed by the following method on the obtained intermediate layer-encased sphere of each example. The configuration of each layer (combination of the core and the intermediate layer) and the eccentricity evaluation thereof are shown in Tables 3 to 8.

Eccentricity Inspection

Evaluation was performed while the core was encased with the intermediate layer.

As described above, in the eccentricity evaluation, as shown in FIG. 1, when the core was encased with the intermediate layer having a thickness of 1.2 mm, the intermediate layer material was injection molded while intentionally making the thickness T (1.2 mm)/T (1.2 mm) eccentric to $T_1$ (1.7 mm)/$T_2$ (0.7 mm). The eccentricity is rated by visual observation by an operator according to the following criteria.

[Rating Criteria]

Very good: The eccentric state can be clearly seen.

Good: The eccentric state can be seen.

Fair: The eccentric state is difficult to see.

NG: The eccentric state is not seen at all.

TABLE 3

| | | Comparative Example 1 | | | | | | | | |
|---|---|---|---|---|---|---|---|---|---|---|
| | | (1) | (2) | (3) | (4) | (5) | (6) | (7) | (8) | (9) |
| Core | Formula | No. 1 | No. 2 | No. 3 | No. 4 | No. 5 | No. 6 | No. 7 | No. 8 | No. 9 |
| | Color | Red | Light red | Blue | Light blue | Yellow | Orange | Light green | Ligh purple | White |
| | L1 | 65.6 | 84.8 | 69.9 | 82.9 | 93.8 | 78.4 | 86.5 | 81.2 | 94.9 |
| | a1 | 37.4 | 16.2 | −2.3 | −6.5 | −8.1 | 14.2 | −18.8 | 4.4 | −1.1 |
| | b1 | −3.3 | 2.2 | −22.4 | −12.0 | 31.5 | 23.7 | 5.7 | −2.9 | 6.2 |
| Intermediate layer | Formula | A | A | A | A | A | A | A | A | A |
| | Total light transmittance (%) | 91.3 | 91.3 | 91.3 | 91.3 | 91.3 | 91.3 | 91.3 | 91.3 | 91.3 |
| Intermediate layer-encased sphere | L2 | 62.4 | 80.1 | 65.9 | 78.9 | 84.4 | 74.0 | 81.7 | 77.8 | 89.4 |
| | a2 | 33.6 | 13.0 | −2.5 | −6.1 | −7.5 | 10.7 | −15.8 | 4.1 | −1.2 |
| | b2 | −3.3 | 3.9 | −18.1 | −9.0 | 31.7 | 23.1 | 4.9 | −2.6 | 4.1 |
| Color difference | ΔE | 5.0 | 5.9 | 5.9 | 5.0 | 9.4 | 5.6 | 5.7 | 3.5 | 6.0 |
| | ΔL (L1 − L2) | 3.2 | 4.7 | 4.0 | 4.0 | 9.4 | 4.4 | 4.9 | 3.4 | 5.6 |
| Color difference at the time of eccentricity | ΔL (difference in L value) | −0.4 | −1.8 | 2.4 | 1.6 | −1.8 | 0.4 | −2.0 | −1.5 | 0.5 |
| | ΔE | 1.9 | 1.5 | 1.3 | 1.4 | 1.4 | 1.8 | 1.3 | 1.6 | 1.3 |
| Eccentricity inspection (evaluation) | | NG | NG | NG | NG | NG | NG | NG | NG | NG |

TABLE 4

| | | Comparative Example 2 | | | | | | | | |
|---|---|---|---|---|---|---|---|---|---|---|
| | | (1) | (2) | (3) | (4) | (5) | (6) | (7) | (8) | (9) |
| Core | Formula | No. 1 | No. 2 | No. 3 | No. 4 | No. 5 | No. 6 | No. 7 | No. 8 | No. 9 |
| | Color | Red | Light red | Blue | Light blue | Yellow | Orange | Light green | Light purple | White |
| | L1 | 65.6 | 84.8 | 69.9 | 82.9 | 93.8 | 78.4 | 86.5 | 81.2 | 94.9 |
| | al | 37.4 | 16.2 | −2.3 | −6.5 | −8.1 | 14.2 | −18.8 | 4.4 | −1.1 |
| | b1 | −3.3 | 2.2 | −22.4 | −12.0 | 31.5 | 23.7 | 5.7 | −2.9 | 6.2 |
| Intermediate layer | Formula | B | B | B | B | B | B | B | B | B |
| | Total light transmittance (%) | 59.8 | 59.8 | 59.8 | 59.8 | 59.8 | 59.8 | 59.8 | 59.8 | 59.8 |
| Intermediate layer-encased sphere | L2 | 78.3 | 85.1 | 76.8 | 83.8 | 93.0 | 80.9 | 87.5 | 81.9 | 94.9 |
| | a2 | 15.7 | 12.0 | −2.0 | −5.5 | −5.0 | 11.3 | −15.3 | 2.8 | −1.3 |
| | b2 | 0.8 | 2.5 | −10.7 | −7.3 | 23.0 | 14.5 | 4.9 | −1.6 | 4.8 |
| Color difference | ΔE | 25.4 | 4.2 | 13.6 | 4.9 | 9.1 | 9.9 | 3.7 | 2.2 | 1.4 |
| | ΔL (L1 − L2) | −14.4 | −1.8 | −9.3 | −2.6 | 0.9 | −5.2 | −1.6 | −3.6 | 0.3 |
| Color difference at the time of eccentricity | ΔL (difference in L value) | −12.7 | −0.3 | −6.9 | −0.9 | 0.8 | −2.5 | −1.0 | −0.7 | 0.0 |
| | ΔE | 1.9 | 1.6 | 2.1 | 3.0 | 3.2 | 3.0 | 1.9 | 1.9 | 0.4 |
| Eccentricity inspection (evaluation) | | Fair | NG | NG | Fair | Fair | Fair | NG | NG | NG |

TABLE 5

| | | Example 1 | Comp. Ex. 3 | Example 1 | Comparative Example 3 | | Example 1 | Comparative Example 3 | | |
|---|---|---|---|---|---|---|---|---|---|---|
| | | (1) | (1) | (2) | (2) | (3) | (3) | (4) | (5) | (6) |
| Core | Formula | No. 1 | No. 2 | No. 3 | No. 4 | No. 5 | No. 6 | No. 7 | No. 8 | No. 9 |
| | Color | Red | Light red | Blue | Light blue | Yellow | Orange | Light green | Light purple | White |
| | L1 | 65.6 | 84.8 | 69.9 | 82.9 | 93.8 | 78.4 | 86.5 | 81.2 | 94.9 |
| | a1 | 37.4 | 16.2 | −2.3 | −6.5 | −8.1 | 14.2 | −18.8 | 4.4 | −1.1 |
| | b1 | −3.3 | 2.2 | −22.4 | −12.0 | 31.5 | 23.7 | 5.7 | −2.9 | 6.2 |
| Intermediate layer | Formula | C | C | C | C | C | C | C | C | C |
| | Total light transmittance (%) | 48.5 | 48.5 | 48.5 | 48.5 | 48.5 | 48.5 | 48.5 | 48.5 | 48.5 |
| Intermediate layer-encased sphere | L2 | 80.0 | 86.6 | 79.2 | 85.5 | 92.9 | 83.6 | 88.1 | 84.8 | 94.7 |
| | a2 | 13.8 | 10.3 | −1.8 | −4.8 | −3.7 | 9.0 | −11.3 | 1.9 | −1.3 |
| | b2 | 1.0 | 2.8 | −8.0 | −6.0 | 18.0 | 10.5 | 4.2 | −0.9 | 4.8 |
| Color difference | ΔE | 27.9 | 6.2 | 17.2 | 6.7 | 14.2 | 15.1 | 7.7 | 4.8 | 1.4 |
| | ΔL (L1 − L2) | −14.4 | −1.8 | −9.3 | −2.6 | 0.9 | −5.2 | −1.6 | −3.6 | 0.3 |
| Color difference at the time of eccentricity | ΔL (difference in L value) | 2.3 | 0.8 | 2.0 | 1.4 | 0.2 | 1.9 | 0.3 | 1.7 | −0.3 |
| | ΔE | 3.9 | 2.1 | 3.1 | 3.7 | 4.4 | 3.9 | 2.5 | 2.2 | 0.4 |
| Eccentricity inspection (evaluation) | | Good | Fair | Good | NG | Fair | Good | Fair | Fair | NG |

TABLE 6

| | | Example 2 | Comp. Ex. 4 | Example 2 | | Comp. Ex. 4 | Example 2 | Comp. Ex. 4 | Example 2 | Comp. Ex. 4 |
|---|---|---|---|---|---|---|---|---|---|---|
| | | (1) | (1) | (2) | (3) | (2) | (4) | (3) | (5) | (4) |
| Core | Formula | No. 1 | No. 2 | No. 3 | No. 4 | No. 5 | No. 6 | No. 7 | No. 8 | No. 9 |
| | Color | Red | Light red | Blue | Light blue | Yellow | Orange | Light green | Light purple | White |
| | L1 | 65.6 | 84.8 | 69.9 | 82.9 | 93.8 | 78.4 | 86.5 | 81.2 | 94.9 |
| | a1 | 37.4 | 16.2 | −2.3 | −6.5 | −8.1 | 14.2 | −18.8 | 4.4 | −1.1 |
| | b1 | −3.3 | 2.2 | −22.4 | −12.0 | 31.5 | 23.7 | 5.7 | −2.9 | 6.2 |
| Intermediate layer | Formula | D | D | D | D | D | D | D | D | D |
| | Total light transmittance (%) | 36.0 | 36.0 | 36.0 | 36.0 | 36.0 | 36.0 | 36.0 | 36.0 | 36.0 |
| Intermediate layer-encased sphere | L2 | 82.0 | 88.0 | 81.5 | 87.0 | 92.7 | 86.3 | 88.3 | 87.5 | 95.1 |
| | a2 | 12.0 | 8.7 | −1.5 | −4.1 | −2.8 | 7.7 | −5.1 | −3.3 | −1.1 |
| | b2 | 0.6 | 2.8 | −7.3 | −5.0 | 15.2 | 7.6 | 1.8 | 1.0 | 4.6 |
| Color difference | ΔE | 30.4 | 8.1 | 19.1 | 8.5 | 17.2 | 19.1 | 14.3 | 10.7 | 1.6 |
| | ΔL (L1 − L2) | −16.3 | −3.2 | −11.6 | −4.1 | 1.1 | −7.9 | −1.8 | −6.3 | −0.2 |
| Color difference at the time of eccentricity | ΔL (difference in L value) | 4.1 | 1.3 | 3.0 | 2.0 | 0.4 | 2.5 | 0.9 | 1.9 | −0.5 |
| | ΔE | 6.2 | 2.5 | 4.2 | 4.5 | 5.5 | 4.7 | 3.2 | 2.3 | 0.6 |
| Eccentricity inspection (evaluation) | | Very good | Fair | Good | Fair | Fair | Good | Fair | Good | NG |

TABLE 7

| | | Example 3 | | | | Comp. Ex. 5 | Example 3 | Comp. Ex. 5 | Example 3 | Comp. Ex. 5 |
|---|---|---|---|---|---|---|---|---|---|---|
| | | (1) | (2) | (3) | (4) | (1) | (5) | (2) | (6) | (3) |
| Core | Formula | No. 1 | No. 2 | No. 3 | No. 4 | No. 5 | No. 6 | No. 7 | No. 8 | No. 9 |
| | Color | Red | Light red | Blue | Light blue | Yellow | Orange | Light green | Light purple | White |
| | L1 | 65.6 | 84.8 | 69.9 | 82.9 | 93.8 | 78.4 | 86.5 | 81.2 | 94.9 |
| | a1 | 37.4 | 16.2 | −2.3 | −6.5 | −8.1 | 14.2 | −18.8 | 4.4 | −1.1 |
| | b1 | −3.3 | 2.2 | −22.4 | −12.0 | 31.5 | 23.7 | 5.7 | −2.9 | 6.2 |

TABLE 7-continued

| | | Example 3 | | | | Comp. Ex. 5 | Example 3 | Comp. Ex. 5 | Example 3 | Comp. Ex. 5 |
|---|---|---|---|---|---|---|---|---|---|---|
| | | (1) | (2) | (3) | (4) | (1) | (5) | (2) | (6) | (3) |
| Intermediate layer | Formula | E | E | E | E | E | E | E | E | E |
| | Total light transmittance (%) | 30.1 | 30.1 | 30.1 | 30.1 | 30.1 | 30.1 | 30.1 | 30.1 | 30.1 |
| Intermediate layer-encased sphere | L2 | 83.9 | 89.4 | 83.8 | 88.5 | 92.6 | 89.1 | 88.1 | 90.3 | 95.6 |
| | a2 | 10.3 | 7.1 | −1.2 | −3.4 | −1.9 | 6.4 | 1.1 | −8.4 | −1.0 |
| | b2 | 0.3 | 2.7 | −6.5 | −3.9 | 12.4 | 4.6 | −0.6 | 2.8 | 4.3 |
| Color difference | ΔE | 32.9 | 10.1 | 21.2 | 10.3 | 20.2 | 23.2 | 20.9 | 16.7 | 2.0 |
| | ΔL (L1 − L2) | −18.3 | −4.6 | −13.9 | −5.6 | 1.2 | −10.7 | −1.5 | −9.1 | −0.7 |
| Color difference at the time of eccentricity | ΔL (difference in L value) | 5.8 | 1.9 | 4.0 | 2.6 | 0.6 | 3.1 | 1.5 | 2.2 | −0.7 |
| | ΔE | 8.5 | 3.0 | 5.3 | 5.2 | 6.6 | 5.4 | 3.9 | 2.4 | 0.8 |
| Eccentricity inspection (evaluation) | | Very good | Good | Very good | Very good | Fair | Very good | Fair | Good | NG |

TABLE 8

| | | Comparative Example 6 | | | |
|---|---|---|---|---|---|
| | | (1) | (2) | (3) | (4) |
| Core | Formula | No. 1 | No. 2 | No. 3 | No. 9 |
| | Color | Red | Light red | Blue | White |
| | L1 | 65.6 | 84.8 | 69.9 | 94.9 |
| | a1 | 37.4 | 16.2 | −2.3 | −1.1 |
| | b1 | −3.3 | 2.2 | −22.4 | 6.2 |
| Intermediate layer | Formula | F | F | F | F |
| | Total light transmittance (%) | 0.1 | 0.1 | 0.1 | 0.1 |
| Intermediate layer-encased sphere | L2 | 94.9 | 95.2 | 95.3 | 95.1 |
| | a2 | −0.8 | −0.7 | −0.7 | −0.6 |
| | b2 | 4.1 | 3.9 | 3.7 | 3.9 |
| Color difference | ΔE | 48.6 | 19.9 | 36.5 | 2.3 |
| | ΔL (L1-L2) | −29.3 | −10.4 | −25.4 | −0.1 |
| Color difference at the time of eccentricity | ΔL (difference in L value) | 0.3 | −0.2 | 0.1 | 0.1 |
| | ΔE | 0.3 | 0.3 | 0.2 | 0.3 |
| Eccentricity inspection (evaluation) | | NG | NG | NG | NG |

Japanese Patent Application No. 2022-206365 is incorporated herein by reference. Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A golf ball comprising at least one intermediate layer formed between a core and a cover, wherein an L value (brightness) of the core is not more than 85 in a Lab display based on JIS Z 8722, an L value (brightness) of a sphere (intermediate layer-encased sphere) obtained by encasing the core with the intermediate layer is at least 75 in the Lab display based on JIS Z 8722, a total light transmittance of the intermediate layer at a thickness of 1.0 mm is 25 to 50%, and a color difference ΔE between the core and the intermediate layer encased sphere is at least 10.

2. The golf ball according to claim 1, wherein the intermediate layer has a thickness of from 0.8 to 1.5 mm.

3. The golf ball according to claim 1, wherein the L value (brightness) of the core is not more than 80.

4. The golf ball according to claim 1, wherein the color difference ΔE between the core and the intermediate layer-encased sphere is at least 20.

5. The golf ball according to claim 1, wherein the intermediate layer contains barium sulfate.

6. The golf ball according to claim 5, wherein a content of the barium sulfate is from 8 to 20 wt % with respect to a total amount of materials of the intermediate layer.

* * * * *